US007937022B2

(12) United States Patent
Stuckey et al.

(10) Patent No.: US 7,937,022 B2
(45) Date of Patent: May 3, 2011

(54) NON-REMOVABLE CRU LIGHT SHIELD REPLACEMENT FOR PULL STRIP

(75) Inventors: Aaron M Stuckey, Fairport, NY (US); Jeanne M Koval, Marion, NY (US); Mark T Bartlett, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 440 days.

(21) Appl. No.: 12/207,556

(22) Filed: Sep. 10, 2008

(65) Prior Publication Data

US 2010/0061762 A1 Mar. 11, 2010

(51) Int. Cl.

| | |
|---|---|
| ***G03G 21/18*** | (2006.01) |
| ***B65D 69/00*** | (2006.01) |
| ***B65D 71/00*** | (2006.01) |

(52) U.S. Cl. ..... 399/114; 206/578

(58) Field of Classification Search ..... 399/114, 399/116, 110; 206/578, 316.1; 229/117.19
See application file for complete search history.

(56) References Cited

U.S. PATENT DOCUMENTS

2007/0206972 A1* 9/2007 Tanaka ..... 399/114
* cited by examiner

*Primary Examiner* — David M Gray
*Assistant Examiner* — Billy J Lactaoen
(74) *Attorney, Agent, or Firm* — Ronald E. Prass, Jr.; Prass LLP

(57) ABSTRACT

This is a shroud for housing a replacement photoconductive drum. The shroud has an open gap at its top portion and this gap is covered by at least two overlapping flexible strips that are configured to allow a handle structure to pass therethrough on its way to an exit in the shroud where the photoconductive drum is pushed out of the shroud when installing the drum in a marking machine.

12 Claims, 5 Drawing Sheets

NON-REMOVABLE CRU LIGHT SHIELD REPLACEMENT FOR PULL STRIP

This invention relates to electrophotographic systems and, more specifically to customer photoreceptor replacement units or (CRU).

BACKGROUND

By way of background, in a typical electrophotographic printing process, a photoconductive member, either a belt or drum, is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member to a copy sheet. Heat is applied to the toner particles to permanently affix the powder image to the copy sheet.

After extended use and contact with elevated heat and somewhat abrasive materials such as carrier granules and toner and passing through the various process stations, the photoconductive member becomes worn and in need of replacement. Care must be taken in removing the old photoconductive unit and in installing the new replacement unit so that the photoconductive unit and surrounding machine components are not seriously damaged.

Generally, drum photoreceptor replaceable units have a plastic shroud for physical protection and light damage to the light-sensitive unit. However, it is typical, in order to remove the drum unit from the protective housing, a gap in the plastic housing must be made for a handle or other type of drum removal device. This gap is often covered with a pull strip, an opaque, adhesive-backed paper strip, which is stuck over the gap to the plastic housing and must be removed from the housing before the drum unit can be removed. Once the light-blocking strip has been removed, the light-blocking protection for the drum unit is gone. Additionally, if the adhesive fails on the strip then small pieces of the adhesive could end up on the drum unit causing serious image quality defects.

SUMMARY

This invention includes a new system for covering the gap in the plastic shroud which continues to provide light protection to the drum unit while the drum unit is being removed from the shroud. This invention also eliminates the chance of failed adhesive flaking off the pull strip and falling into the drum unit. The invention provides utilizing two flexible gap-covering strips, each having adhesive on one edge attached to the shroud that would overlap approximately 1-5 mm directly over the gap in the shroud. This would provide light protection to the photoreceptor until installed while eliminating the chance of adhesive-caused contamination of the photoreceptor and the need for the customer to entirely remove the strip prior to inserting the CRU into the marking machine.

Preserving the full functionality of the photoreceptor is important especially considering the complexity of today's high speed marking machines and their imaging. The photoreceptor or photoconductive surface is especially key to a proper functioning especially of today's high speed color and monochrome electrophotographic printers. The shroud of this invention preserves the effectiveness of the photoconductive drum surface by minimizing surface damage and the effects of light on this surface. This invention, in particular, provides a new system involving covering the gap in the plastic shroud for drum photoreceptor replaceable xerographic units. An embodiment of the invention is to utilize two strips, each having adhesive on one edge that would overlap approximately 1-5 mm directly over the gap. These two overlapping strips will cover the gap in the customer replaceable unit (CRU) shroud while being flexible enough to bend when the handle unit passes therethrough upon installing the CRU. As earlier noted, this invention importantly provides improved (A) light protection to the drum unit while it is being removed from the shroud and installed, (B) it eliminates a failure mode whereby the adhesive flakes off the pull strip and falls into the drum unit and contaminates the photoreceptor causing image quality defects and (C) it also eliminates the customer step of removing the adhesive strip from the shroud.

DETAILED DISCUSSION OF DRAWINGS AND PREFERRED EMBODIMENTS

Figure 1:
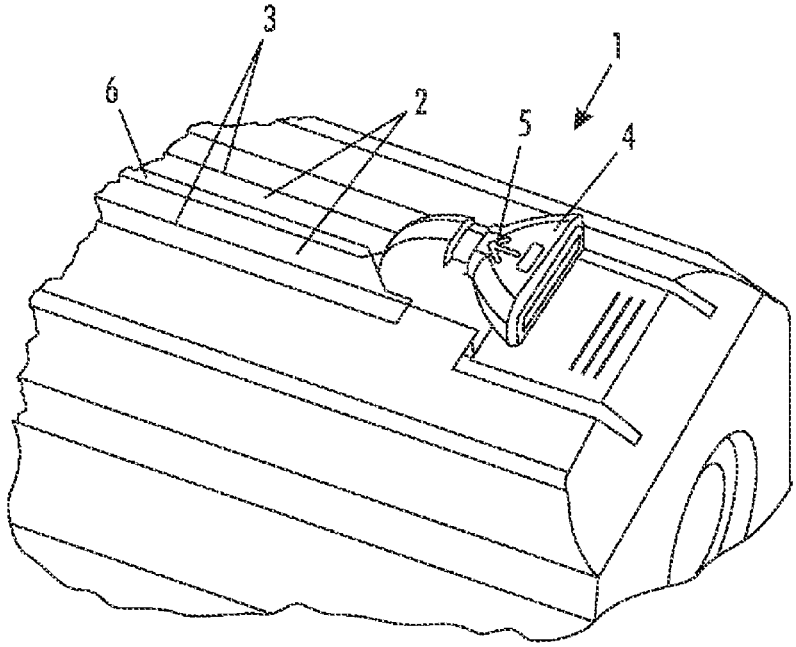
FIG. 1 is a top perspective of an embodiment where the handle portion of the shroud is illustrated.
Figure 2:
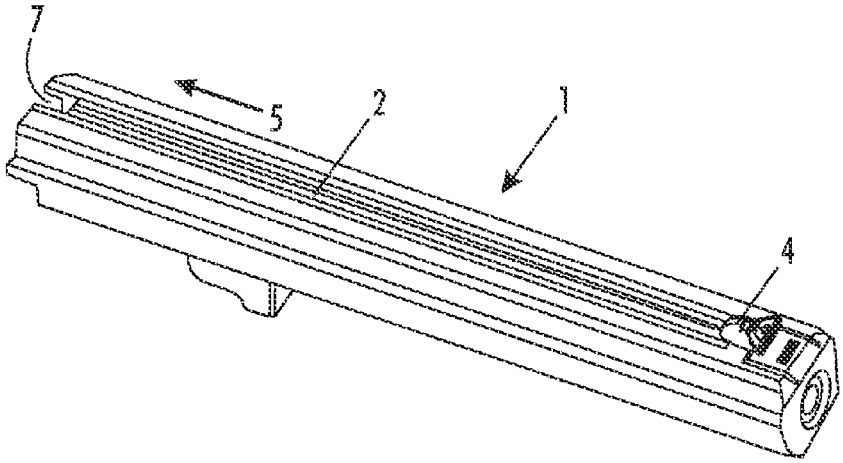
FIG. 2 is a top perspective of the entire shroud of an embodiment of this invention.

In FIGS. 1 and 2, an embodiment of the shroud 1 illustrates that the invention utilizes two adhesive-backed paper or plastic strips 2 that overlap at 6. These two strips overlap coving the gap 3 in the CRU shroud 1 while being flexible enough to bend. As the customer pushes the CRU handle 4 in the direction of arrow 5 out of the CRU shroud at shroud exit 7, the strips 2 flex upward allowing the handle 4 to move to the end of the CRU shroud. After the handle 4 passes through an area, the strips 2 return to the flat position. FIG. 2 shows the entire CRU with shroud 1 and two-part light shield 2.

There are two advantages of this design in comparison to the existing prior art pull strip. The first advantage of this two-part light shield 2 is that the customer does not need to remove it from the plastic shroud 1 which decreases the likelihood of light shock occurring on the photoreceptor drum (not shown located in shroud 1). A second advantage of this design relative to the original pull strip is in the action of the adhesive. An actual situation occurred where the adhesive structure of the original pull strip was not functioning properly. As the customer removed the light shield strip from the CRU shroud, the adhesive broke free and small globs of adhesive material fell onto the photoreceptor drum causing print defects at failure level at the beginning of the cartridge life. The new design eliminates that possibility by not having the light shield strips 2 removed. The photoconductive drum is pushed out of the shroud 1 at shroud exit 7 and installed in the marking apparatus without undue exposure to light. The handle 4 is in movable contact with the photoconductive drum and, as the handle moves toward exit 7, the drum is also moved; i.e. in the direction of arrow 5. One side of each strip 2 is adhered to the shroud at a location 8. The strips 2 may be made from any flexible electrically-insulating material such as plastic, rubber, paper, cloth or mixtures thereof. It is only important that one end 8 of both strips adhere to the shroud at one horizontal edge of the gap 3 and that the overlapping strip ends 6 are flexible enough to allow the handle 4 to be pushed therebetween. The shroud 1 is made from conventional prior art materials, usually a relatively rigid plastic provided it protects the integrity of the enclosured photoconductive drum.

Figure 3:
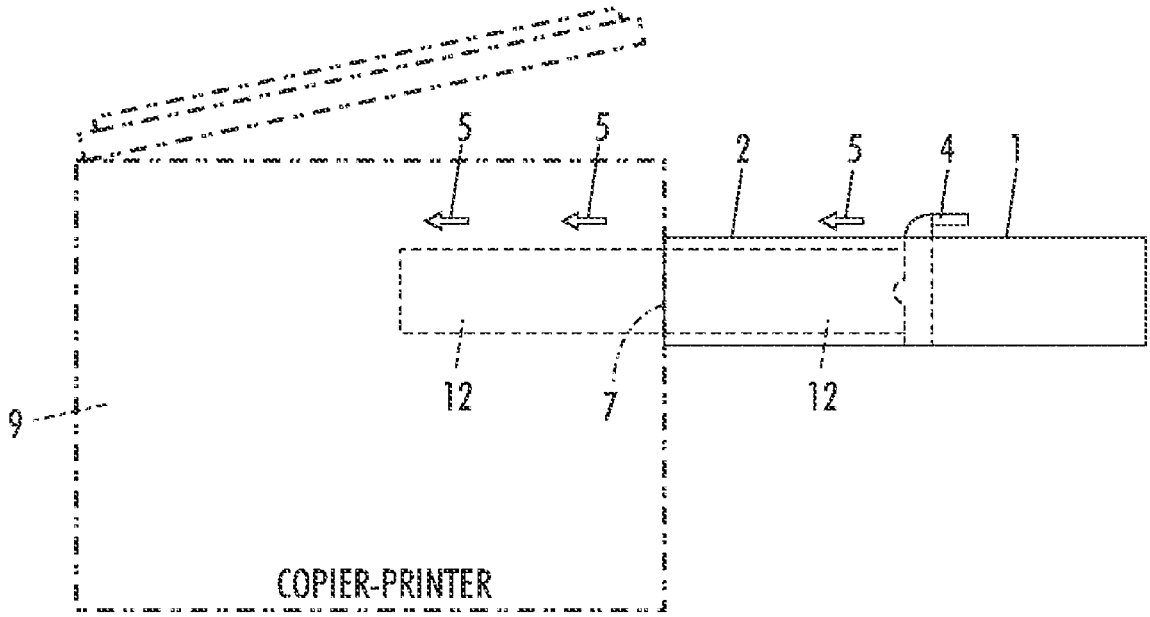
FIG. 3 is a plan view of the shroud as it deposits the electrophotographic drum into the copier or printer.
Figure 6:
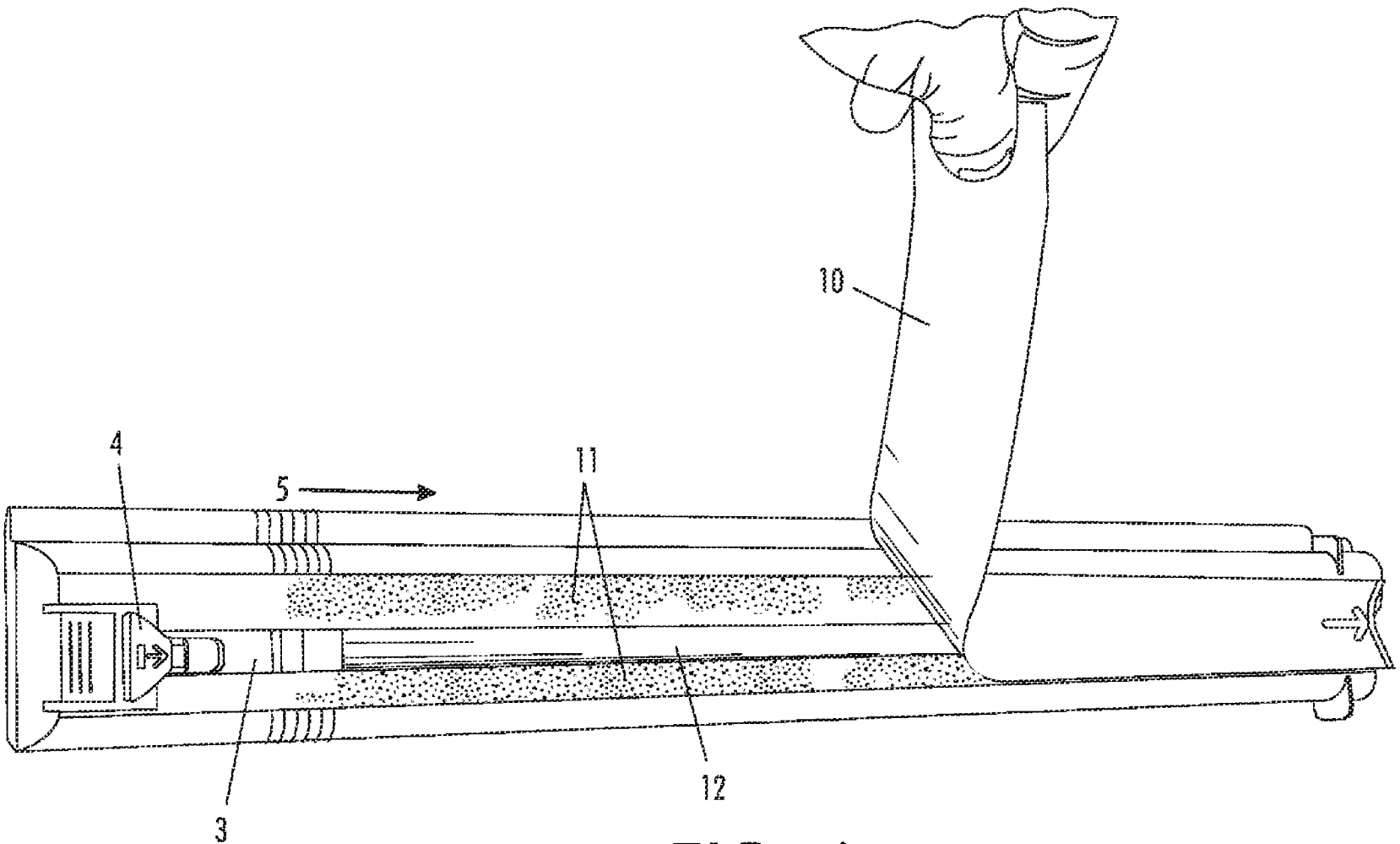
FIG. 6 PRIOR ART
FIG. 6 illustrates a complete prior art shroud having a strip-off cover tape being removed from a gap in the prior art shrouds.

FIG. 3 is a schematic showing the shroud of this invention being inserted into a marking machine (copier or printer) 9. The P.R. drum is always protected by being covered by the machine 9 and the plastic strips 2 of this invention. Therefore, the drum 12 is never exposed to light as the drum 12 is being installed into the machine 9. As the handle 4 pushes the photoconductor drum (P.R.) 12 into machine 9 as shown by arrows 5, the drum 12 always has its gap 3 covered by the marking machine 9 and the strips 2 of this invention. In the prior art, once strip 10 is removed from over the gap 3, the complete P.R. drum 12 is immediately exposed to damaging light (as can be seen in FIG. 6). Once the P.R. drum is installed using the present plastic (or covering strips) 2, the handle 4 generally stays with the P.R. drum 12 as installed (see FIG. 4).

Figure 4:
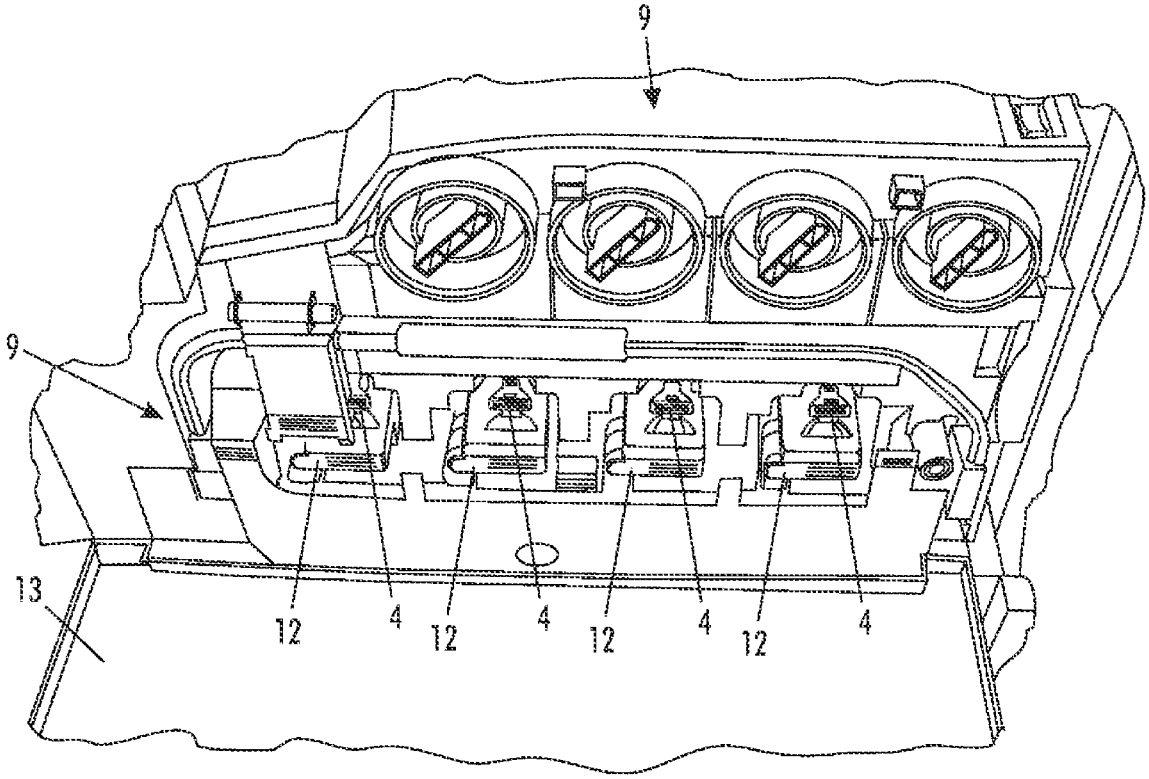
FIG. 4 is a side view of a color printer having multiple photoconductor drums and using the shroud of this invention.

In FIG. 4, a color-marking machine 9 is shown having four P.R. drum units 12 inserted. The shroud 1 of this invention is used having handle 4 in this embodiment staying with the P.R. 12 after installation. The machine door 13 is open to show how the P.R. drums 12 are positioned in marking machine 9. Once the drums 12 are inserted, the shrouds are removed to be reused again. The prior art shrouds cannot be reused unless it is cleaned up, the residual of strips 11 removed, and a new strip applied over the gap.

Figure 5:
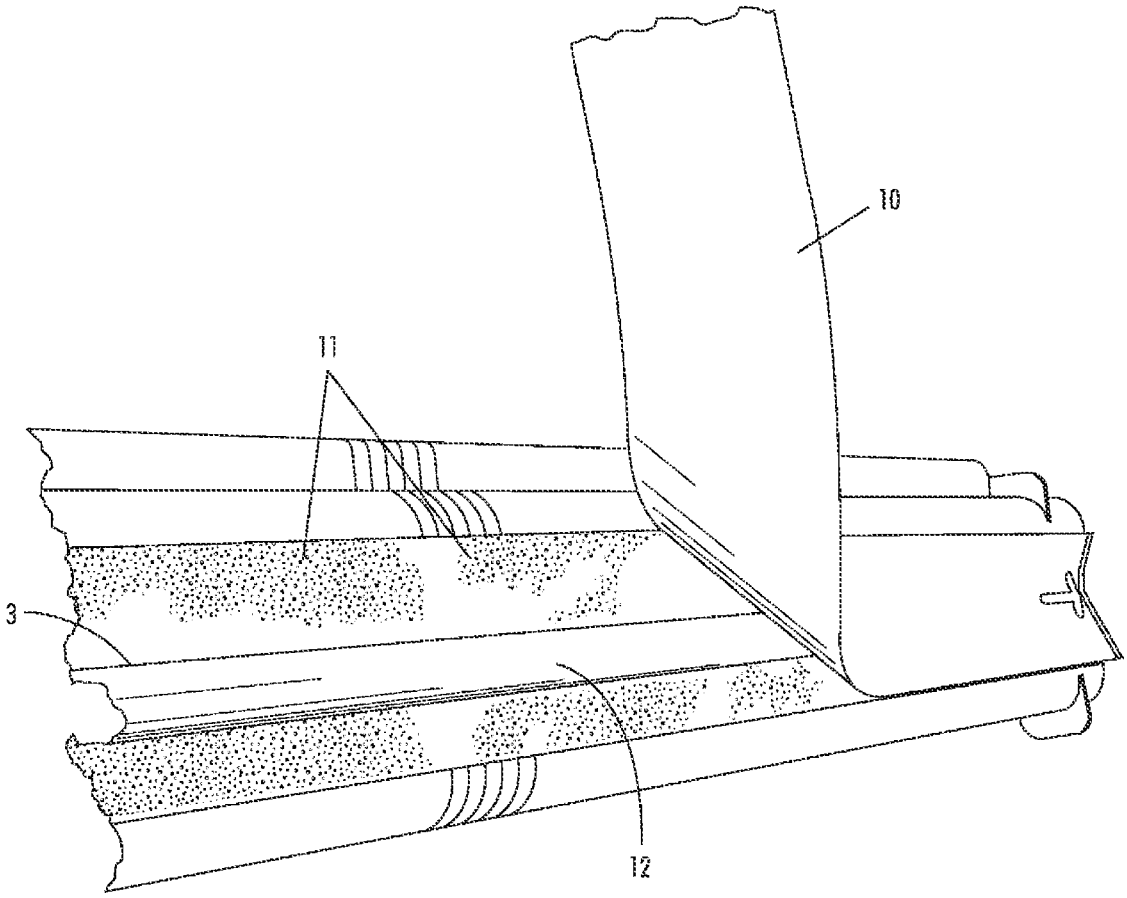
FIG. 5 PRIOR ART
FIG. 5 illustrates a section of prior art strip-off tape covering a gap in prior art shrouds.

In FIG. 5, the prior art shroud is shown having strip 10 partially removed by peeling off the gap 3. Once removed, the P.R. drum 12 is exposed to damaging light. As the strips-off tape 10 is peeled off it leaves tape residual adhesive 11 which often falls onto and permanently damages P.R. drum 12. This alters the photosensitivity and effectiveness of the drum 12 and permanently interferes with proper functioning of the drum 12. The shroud 1 of this invention avoids P.R. damaging light that is caused by an open gap 3. It also avoids the damaging effects on the P.R. of residual tape adhesive 11 left on the gap sides after tape 10 removal. By the use of the overlapping flexible strips 2 of this invention, not only are the above adverse effects avoided by embodiments of the present invention, but the shroud 1 is immediately rendered reusable because the light-blocking overlapping strips are permanently attached to the shroud 1 and stay with the shroud 1 for future use.

In FIG. 6, the entire prior art shroud with a strip-off tape 10 is shown. The tape 10 needs to be removed in order for the push handle to travel through gap 3. Illustrated in FIG. 6 is an actual case of the strip-off tape 10 leaving damaging residual adhesive 11 that can easily fall through gap 3 damaging the P.R. drum 12 before installation. The arrows 5 show the push direction of the handle 4 and P.R. drum 12 as it is pushed through shroud exit 7.

In the present invention, the handle 4 could stay with the drum 12 after installation or can be easily removed if desired. In one embodiment, a 1 cm gap 3 would have a strip overlap of about from 1-5 mm. In a larger shroud having a larger gap (about 18 mm), there would be a strip overlap of about 1-7 mm. The strips 2 of this invention must be light blocking and could be any suitable material such as plastic, paper, cloth, wood or a brush-like configuration.

In summary, the present invention provides a shroud for housing a replacement photoconductive drum. This shroud comprises an elongated housing configured to house a photoconductive drum. The housing is entirely enclosed except for an exit open portion and a gap on its top portion which extends throughout substantially the length of the housing and terminating at the exit.

Positioned over the gap are at least two separate light-blocking, overlapping flexible strips. These strips are configured to permit a movable handle structure to travel therebetween to the shroud exit when removing the photoconductive drum from the shroud. These flexible strips overlap approximately 1-5 mm directly over the gap and are flexible enough to bend upon installation of the replacing photoconductive drum. The strips are configured to provide light protection to the drum while it is removed from the shroud.

The movable handle is configured to move the drum toward the shroud exit during the drum replacement procedure. The shroud has on one first end portion a closed structure and on an opposite second end portion an open end to act as a shroud exit location for the drum.

The strips are constructed of a flexible material selected from the group consisting of plastic, rubber, paper, cloth and mixtures thereof. The strips extend through substantially the entire length of the gap and one side of the strips is attached to the shroud and at the opposite side overlaps at a center gap location with the other strip. The strips are configured to allow passage of the handle at the overlapping portions of the strips.

In a specific embodiment, the shroud comprises an elongated housing configured to house the photoconductive drum. The housing is entirely enclosed except for an exit open portion and a gap on its top portion which extends throughout substantially the length of the housing and terminating at the exit.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A shroud for housing a replacement photoconductive drum, said shroud comprising:

an elongated housing configured to house a photoconductive drum, said housing being entirely enclosed except for an exit open portion and a gap on its top portion which extends throughout substantially the length of said housing and terminating at said exit, positioned over said gap is at least two separate overlapping flexible strips, said strips configured to permit a movable handle structure to travel therebetween to said exit when removing said photoconductive drum from said shroud.

2. The shroud of claim 1 wherein said movable handle is configured to move said drum toward said exit during a drum replacement procedure.

3. The shroud of claim 1 having on one first end portion a closed structure, and on an opposite second end portion an open end to act as an exit location for said drum.

4. The shroud of claim 1 wherein said strips are constructed of a flexible material selected from the group consisting of plastic, rubber, paper, cloth and mixtures thereof.

5. The shroud of claim 1 wherein said strips extend through substantially the entire length of said gap, and wherein one side of said strip is attached to said shroud, and another opposite end overlaps at a center gap location with the other strip.

6. The shroud of claim 1 wherein said strips are configured to allow passage of said handle at said overlapping portions of said strips.

7. A shroud for housing a replacement photoconductive drum, said shroud comprising:

an elongated housing configured to house a photoconductive drum, said housing being entirely enclosed except for an exit open portion and a gap on its top portion which extends throughout substantially the length of said housing and terminating at said exit, positioned over said gap is at least two separate overlapping flexible strips, said strips configured to permit a movable handle structure to travel therebetween to said exit when removing said photoconductive drum from said shroud, said flexible strips overlapping approximately 1-5 mm directly over said gap, and flexible enough to bend upon installation of said replaceable photoconductive drum, said strips configured to provide light protection to said drum while it is removed from said shroud.

8. The shroud of claim 7 wherein said movable handle is configured to move said drum toward said exit during a drum replacement procedure.

9. The shroud of claim 7 having on one first end portion a closed structure, and on an opposite second end portion an open end to act as an exit location for said drum.

10. The shroud of claim 7 wherein said strips are constructed of a flexible material selected from the group consisting of plastic, rubber, paper, cloth and mixtures thereof.

11. The shroud of claim 7 wherein said strips extend through substantially the entire length of said gap, and wherein one side of said strip is attached to said shroud, and another opposite end overlaps at a center gap location with the other strip.

12. The shroud of claim 7 wherein said strips are configured to allow passage of said handle at said overlapping portions of said strips.

* * * * *